US006679462B1

(12) United States Patent
Valdez

(10) Patent No.: US 6,679,462 B1
(45) Date of Patent: Jan. 20, 2004

(54) SNAP-RING STIFFENER APPARATUS HAVING A SCOOPING RAMP EDGE AND METHOD FOR STIFFENING BAG OPENINGS AND OTHER FLEXIBLE FABRICS

(75) Inventor: Victor G. Valdez, Nogales, AZ (US)

(73) Assignee: Jorge B. Gamez, Nogales, AZ (US)

( * ) Notice: Subject to any disclaimer, the term of this patent is extended or adjusted under 35 U.S.C. 154(b) by 0 days.

(21) Appl. No.: 10/251,239

(22) Filed: Sep. 20, 2002

Related U.S. Application Data

(60) Provisional application No. 60/387,134, filed on Jun. 7, 2002.

(51) Int. Cl.[7] ..... B65B 67/04

(52) U.S. Cl. ..... 248/99; 248/101; 248/95; 292/DIG. 30

(58) Field of Search ..... 248/99, 101, 95, 248/97; 24/461; 141/390, 391; 220/495.08, 495.11, 771, 908.1; 292/DIG. 30, 87, 89, 128

(56) References Cited

U.S. PATENT DOCUMENTS

| | | | | | |
|---|---|---|---|---|---|
| 3,522,922 | A | * | 8/1970 | Byron et al. | 248/101 |
| 3,779,419 | A | * | 12/1973 | Heitz | 220/495.11 |
| 4,378,924 | A | * | 4/1983 | Christensen | 248/101 |
| 4,550,440 | A | * | 10/1985 | Rico | 383/33 |
| 4,610,039 | A | * | 9/1986 | Stern | 4/285 |
| 4,753,367 | A | * | 6/1988 | Miller et al. | 220/495.11 |
| 4,765,579 | A | * | 8/1988 | Robbins et al. | 248/101 |
| 4,899,967 | A | * | 2/1990 | Johnson | 248/97 |
| 5,147,055 | A | * | 9/1992 | Samson et al. | 220/259.2 |
| 5,322,178 | A | * | 6/1994 | Foos | 220/326 |
| 5,419,452 | A | * | 5/1995 | Mueller et al. | 220/495.08 |
| 5,520,303 | A | * | 5/1996 | Bernstein et al. | 220/495.08 |
| 5,556,063 | A | * | 9/1996 | Boyd | 248/99 |
| 5,588,622 | A | * | 12/1996 | Gordon, Sr. | 248/101 |
| 5,641,138 | A | * | 6/1997 | Cronk et al. | 248/99 |
| 5,836,553 | A | * | 11/1998 | Bergaila | 248/99 |
| 5,913,496 | A | | 6/1999 | Valdez | |
| 6,416,023 | B1 | * | 7/2002 | Satsky | 248/99 |

* cited by examiner

*Primary Examiner*—Leslie A. Braun
*Assistant Examiner*—Amy Sterling
(74) *Attorney, Agent, or Firm*—LaRiviere, Grubman & Payne, LLP

(57) ABSTRACT

A stiffener apparatus, including first and second stiffener body sections, each section forming an open, geometric structure, with U-shaped channels facilitating mechanically mating the two sections, i.e. a quasi-congruent, multi-planar surface, snap-ring construction, that effects reliable compression of flexible material disposed between two mating sections. The stiffener sections are sized for fitting an opening of a flexible trash bag. An integral clamping mechanism securely latches the stiffener sections together and facilitates separating the sections. Mating channels compress the outer edges of the trash bag's opening material, greatly improving the compression fit keeping the trash bag open, especially in heavily loaded trash bag conditions. Each stiffener section, has a scooping ramp edge member for channeling material into the trash bag. One stiffener section has at least one handle with a notch for hanging the apparatus. The apparatus has means for attaching an optional hinged cover.

8 Claims, 7 Drawing Sheets

SNAP-RING STIFFENER APPARATUS HAVING A SCOOPING RAMP EDGE AND METHOD FOR STIFFENING BAG OPENINGS AND OTHER FLEXIBLE FABRICS

CROSS-REFERENCE TO RELATED DOCUMENTS

This application claims priority to U.S. Provisional Patent Application No. 60/387,134, filed Jun. 7, 2002. This application is related to U.S. Pat. No. 5,913,496, issued Jun. 22, 1999, "Snap-Ring Stiffener Apparatus Having a Scoop-Like Edge, and Method for Stiffening Bag Openings and Other Flexible Fabrics" having a common inventor, Victor G. Valdez.

FIELD OF THE INVENTION

The present invention relates to stiffeners. More particularly, the present invention relates to stiffeners used for stiffening openings of flexible containers. Even more particularly, the present invention relates to stiffeners for stiffening openings of flexible trash bag containers and for stiffening other flexible sheet material that is functional in a stiffened state.

DESCRIPTION OF THE PRIOR ART

Reference is made to U.S. Pat. No. 5,913,496, (hereinafter '496) which describes an apparatus, namely, a snap-ring stiffener apparatus for solving the problem of keeping flexible containers, namely flexible trash bags, open while filling them. While the invention of '496 solved many of the problems described in the patent, it is now evident that a number of improvements make the apparatus even more useful and convenient.

The flexible container, namely, the flexible trash bag, has become the norm in management of trash in the residential and commercial environments. While most applications that require the use of a flexible trash bag involve using the product as a trash can liner, there are numerous applications where the flexible trash bag is used by itself without the aid of the trash can to keep the trash bag opened. In the trash can liner application the upper portion of the trash can structure facilitates maintaining the trash bag in an opened state, i.e. creates a stiffened open state of the trash bag opening. The discrete application of the trash bag presents to the user the common problem of keeping the trash bag opened so that trash, or whatever item is to be placed into the trash bag, can be deposited into the trash bag. Typically, the user solves the problem by inserting a curled arm into the trash bag opening to encircle the opening and then uses a free hand for depositing the trash, or other items, into the trash bag. The task of trash pick-up in the foregoing manner can become unpleasant when the trash involves picking up pet excrements from the yard. Other tasks where a discrete trash bag is used, and where maintaining the trash bag in an opened state presents a problem, include picking up leaves, picking up grass clippings in a residential environment, and picking up roadside trash by highway department personnel in a commercial environment, especially if the wind is blowing.

Other applications besides trash containment, and lawn and garden refuse containment, that use flexible containers requiring maintaining the opening in an open state include day care centers, sport institutions outdoor activities, kitchens, recycling organizer, shopping bags, and numerous school and club activities. The flexible containers are typically canvas or net bags used to store clothes, toys, or sporting equipment, such as balls and other sport gear. Additionally, other applications exist where flexible sheet material is used in a stiffened state including sifting/sieving and embroidery tasks. The flexible sheet material, such as a mesh material, used in these applications is typically disposed and captured between two concentric ring devices to stiffen the mesh material. The concentric ring devices are circular and do not produce a tight and reliable securement of the flexible material. The structure of these concentric ring devices is such that a mating compression state comprises an outer, single plane wall of a small ring device expanding against the inner single plane wall of a larger ring device. The plane-plane compression fit is deemed unreliable, especially in sifting heavy material.

A need was seen for stiffener devices that are useable to keep the opening of discrete trash bags in an opened state, and which have means for channeling trash items into the trash bag. Additionally, a need was seen to exist for a stiffener device that produces a reliable compression fit for retaining and securing flexible sheet material. The need is seen to exist for a bag opening stiffener apparatus that is rugged and that will withstand robust handling in these other applications and can be hung in a convenient way to provide ready access to the bag opening so materials may be inserted or removed from the bag as required. Additionally, many applications are improved upon addition of a hinged cover attached to the stiffener apparatus to provide a covering of the bag opening. The cover may be solid, to reduce odors escaping or rain or leaves entering the bag, or the cover may have a mesh covered opening to allow air circulation, for example for wet clothing, while still effectively preventing insects or vermin from entering the bag.

Applicant provided solutions to the foregoing problems in U.S. Pat. No. 5,913,496 by providing stiffener devices that are useable to keep the opening of discrete trash bags in an opened state in applications described above, and which have means for channeling trash items into the trash bag.

Applicant has now recognized a need for additional improvements over the '496 invention which will make the invention even more useful and convenient including an improved and more convenient latching mechanism, improved handles with leveling notches, optionally, a hinged cover, and, also optionally, a size to advantageously use retail store plastic bags such as grocery or shopping bags.

It is therefore a primary object of this invention to provide a stiffener device that is useable for keeping the opening of flexible containers in an opened state.

A related primary object of this invention is to provide a stiffener device that is useable for keeping the opening of discrete trash bags in an opened state.

Another object of this invention is to provide a stiffener device that is useable for keeping the opening of discrete trash bags in an opened state, and which has means for channeling trash items into the trash bag.

Yet another object of this invention is to provide a stiffener device that is useable with flexible sheet material to facilitate an intended function of the sheet material.

Yet another object of this invention is to provide a stiffener device adapted for use with flexible sheet material and is provided with structure for ease of handling and designed with means to reliably secure the flexible material to the stiffener device during use.

Yet another object of this invention is to provide a stiffener device with an improved means for engaging and disengaging the two parts of the invention to facilitate insertion and removal of a trash bag or other flexible material.

Yet another object of this invention is to provide a stiffener device that is adapted to be self leveling to hang in a level position to facilitate loading the trash bag or other bags.

Yet another object of this invention is to provide a stiffener device that is adapted to have a hinged cover connected to the stiffener device for covering the opening of the stiffener device.

Yet another object of this invention is to provide a stiffener device that is adapted to be dimensionally sized to be used with common size of retail store plastic bags such as grocery or shopping bags.

SUMMARY OF THE INVENTION

Accordingly, the foregoing objects are accomplished by providing a stiffener apparatus formed having a geometrically shaped stiffener body member adapted for stiffening flexible sheet material. The stiffener body member comprises an open structure adapted for compressing outer perimeter portions of the flexible material to effect a stiffened state of the material, and is also provided with improved clamp structures for clamping and assuring a firmly secure state of the flexible sheet material to the stiffener body member. The stiffener body member is especially designed for maintaining an opening of a flexible container, such as a trash bag, or a bag of smaller dimensions, for example a plastic retail grocery or shopping bag in an opened state. The stiffener body member is further provided with a scooping ramp edge member for channeling material into an opened flexible container. The stiffener body member of the stiffener apparatus is preferably formed comprising first and second stiffener body sections, each stiffener section being formed as an open, octagonally shaped structure, and provided with geometrically shaped channel that facilitate mechanically mating of one section with the other, i.e. a snap-ring type construction, that effects a reliable compression of flexible material disposed between the two mating stiffener body sections. The stiffener body member is preferably formed comprising locking tabs or snaps to secure the two members together maintaining the compression of flexible material disposed between the two mating stiffener sections. The open, octagonally, shaped stiffener sections are especially sized for fitting an opening of a flexible trash bag container or, in an alternative embodiment, a bag of smaller dimensions, for example a plastic retail store plastic bag such as grocery or shopping bag. The geometrically shaped mating channels compress the outer edges of the trash bag's opening material between multi-planar surfaces that greatly improve the compression fit in keeping the trash bag opening in an opened state, especially in heavily loaded conditions. In a stiffened trash bag opening application, the mated stiffener sections maintaining the trash bag open, are provided with mating scooping ramp edge members for channeling material into the trash bag. Additionally, the stiffener section, formed dimensionally as the male component, is provided with a plurality of handles for ease of manipulating, carrying and hanging the trash bag with the installed stiffener device. The provided handles are formed to contain a notch to facilitate hanging the stiffener for use or storage. The notch is preferably formed and positioned such that when the stiffener is hung on a device designed for hanging articles, for example a nail partially driven into a wall or fence post, the stiffener will hang in a stable and essentially level position, thus facilitating filling the opened bag. The stiffener section, formed dimensionally as the female component, is provided with a plurality of means for optionally attaching a cover for covering the open portion of the trash bag for preventing spilling of the bag's contents or for prevention of insects or other vermin from entering the open bag. The optional cover is provided with complementary means for being attached to the female component, and includes a handle for opening and closing the cover. Additionally, said cover may be constructed of plastic or metal and may be solid or may include an annular opening covered by fabric or wire mesh for air circulation.

Therefore, to the accomplishment of the foregoing objects, the invention consists of the foregoing features hereinafter fully described and particularly pointed out in the claims, the accompanying drawings and the following disclosure describing in detail the invention, such drawings and disclosure illustrating but one of the various ways in which the invention may be practiced.

DESCRIPTION OF THE PREFERRED EMBODIMENT OF THE INVENTION

Figure 1:
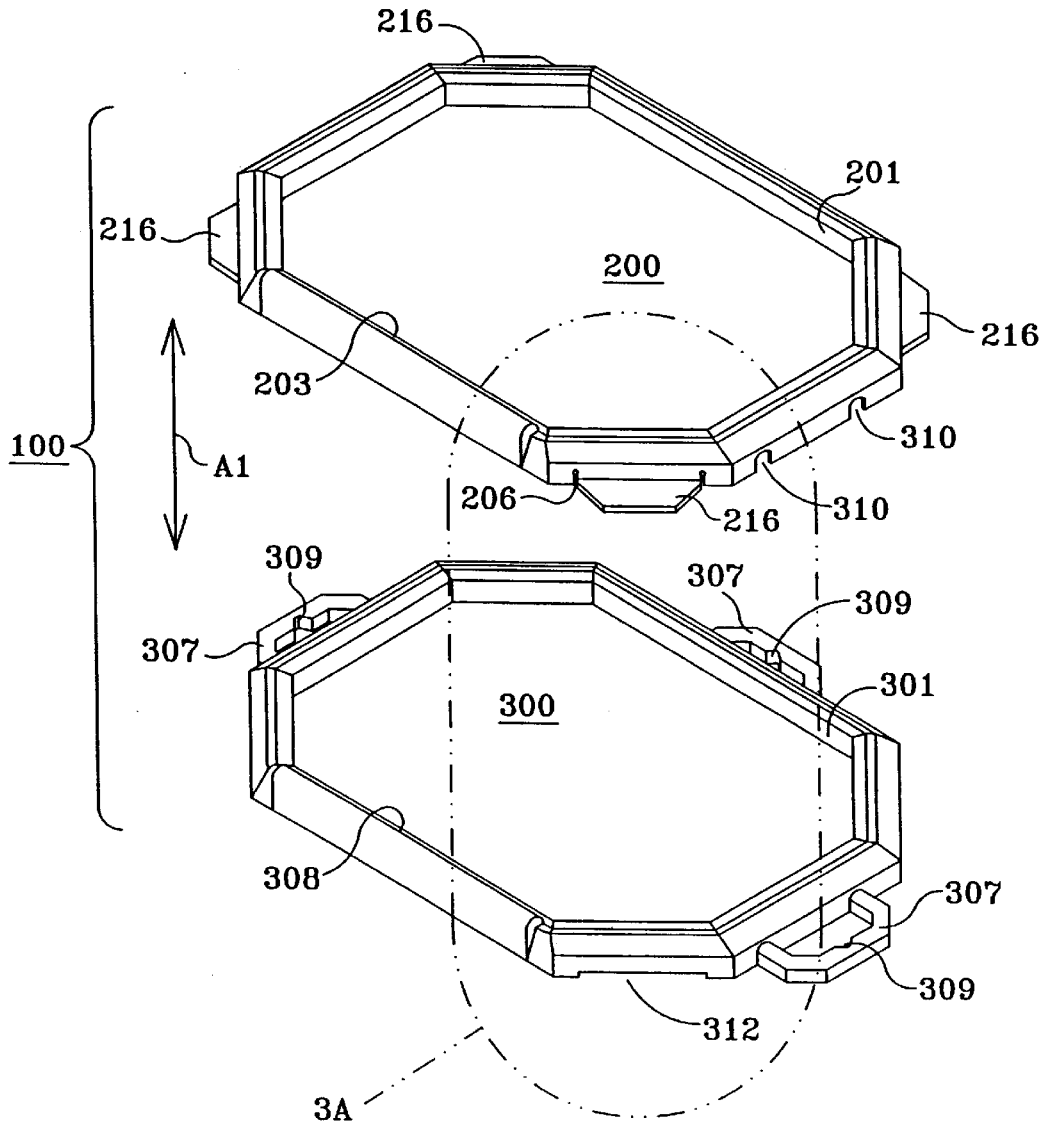
FIG. 1 is an exploded perspective view of a stiffener apparatus in accordance with the present invention showing first and second stiffener sections designed having a octagonal shape.
Figure 2:
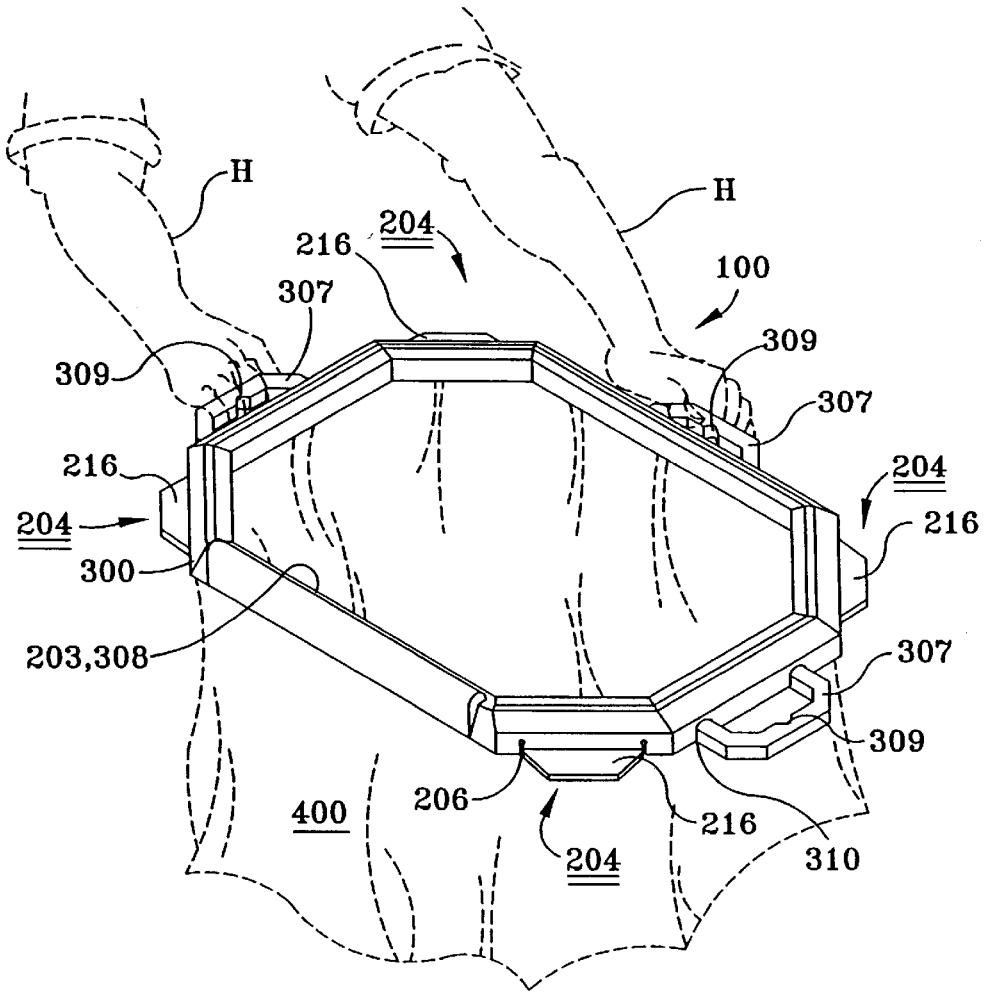
FIG. 2 is a perspective view of the stiffener apparatus shown in FIG. 1 installed on a flexible trash container being held upright by a person.

FIG. 1 shows a stiffener apparatus 100 in accordance with the present invention showing a first stiffener section 200 and a second stiffener section 300, each designed having a octagonal shape. As shown in FIG. 2, stiffener apparatus 100 has particular utility for use in keeping an opening of a flexible trash container 400 in an opened state. As shown in FIG. 1 each stiffener section 200, 300 is an open structure 201, 301 configured in an octagonal shape and designed for mating as indicated by arrow A1. Each structure 201, 301 is preferably formed from a rugged, durable, flexible plastic material that is resistant to corrosive chemicals, that can withstand hot (100–130 degrees Fahrenheit) sunny outdoor conditions, and in particular can be used in wet, grimy environments. As shown in FIG. 2 stiffener apparatus 100 is provided with clamp assemblies 204 that are functional for securing stiffener sections 200 and 300 when in a mated state. The clamp assembly 204 will be discussed in following sections. Both stiffener sections 200 and 300 are provided with mating scooping ramp edge portions 203 and 308, respectively. Scooping ramp edge portions 203, 308 have utility for channeling trash items into the opening of a flexible trash container 400 utilizing stiffener apparatus 100. Further, stiffener section 300 is provided handles 307 disposed on structure 301 to facilitate hanging the in-use stiffener apparatus in different orientations. Structure 201 is formed with grooves 310 such that, after engagement of sections 200, 300, the handles 307 protrude through grooves 310. The handles 307 are formed to contain notches 309 to facilitate hanging the stiffener apparatus 100 for use or storage.

FIG. 2 shows stiffener apparatus 100 installed on a flexible trash container 400 and being held upright by a person's hands H using the provided handles 307 on stiffener section 300. Stiffener section 200 is dimensionally designed as the female component of apparatus 100, while stiffener section 300 is dimensionally designed as the male component of apparatus 100.

Figure 6:
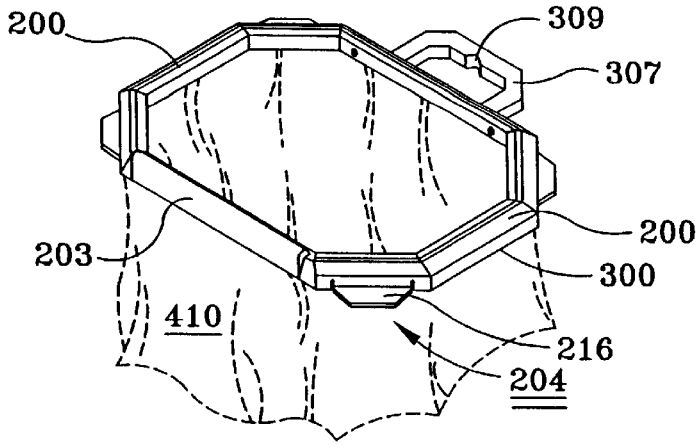
FIG. 6 is a perspective view of an alternative one-handle embodiment of the stiffener apparatus shown in FIG. 2 used with a flexible container of the size of a plastic retail store bag.
Figure 8:
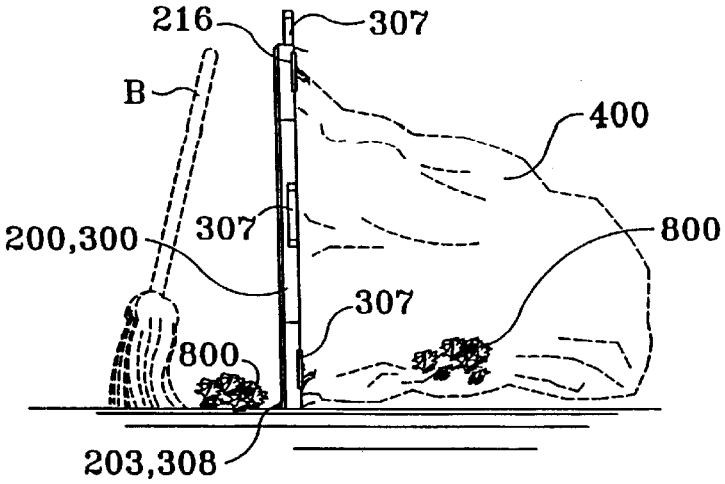
FIG. 8 is a side elevational view showing the stiffener apparatus with a flexible trash container installed in accordance with the present invention, showing the scooping ramp edge being used for channeling trash into a flexible trash container opening.
Figure 9A:
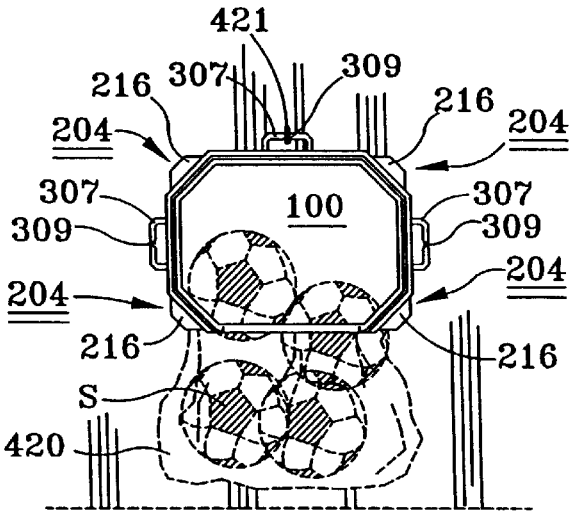
FIG. 9A is a front elevational view showing the stiffener apparatus with a flexible mesh material container installed in accordance with the present invention, showing the stiffener apparatus hanging from a support and used for storage of objects and exhibiting the leveling feature.
Figure 9B:
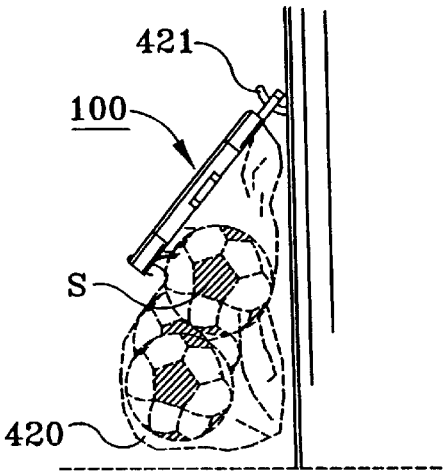
FIG. 9B is a side elevational view showing the stiffener apparatus with a flexible mesh material container installed in accordance with the present invention, showing the stiffener apparatus hanging from a support and used for storage of objects and exhibiting the leveling feature.
Figure 10:
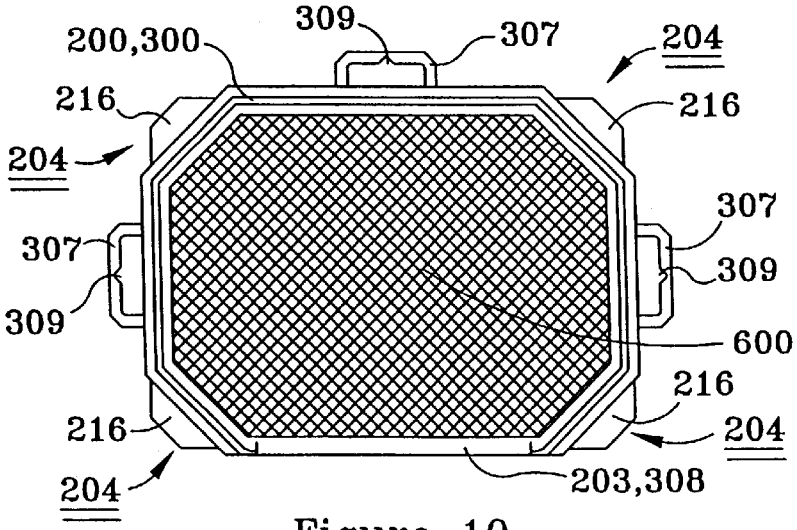
FIG. 10 is a top plan view of the stiffener apparatus with a flexible mesh material installed in accordance with the present invention for use in a sifting/sieving task.

Although apparatus 100 is shown in FIG. 2 in an application with a flexible trash bag, and in FIG. 6 in an application with a small flexible bag, for example retail store plastic bag such as a grocery bag, apparatus 100 has utility with other flexible material and bags, including flexible canvas bags, flexible net bags as shown in FIGS. 9A and 9B and flexible sheet mesh material as shown in FIG. 10. The illustrated applications in FIGS. 2, 6, 8, 9A, 9B and 10 are exemplary and should not be interpreted as a limitation on the invention. As indicated in FIG. 1, each structure 201, 301 is designed for detachably mating as indicated by arrow A1.

Figure 3A:
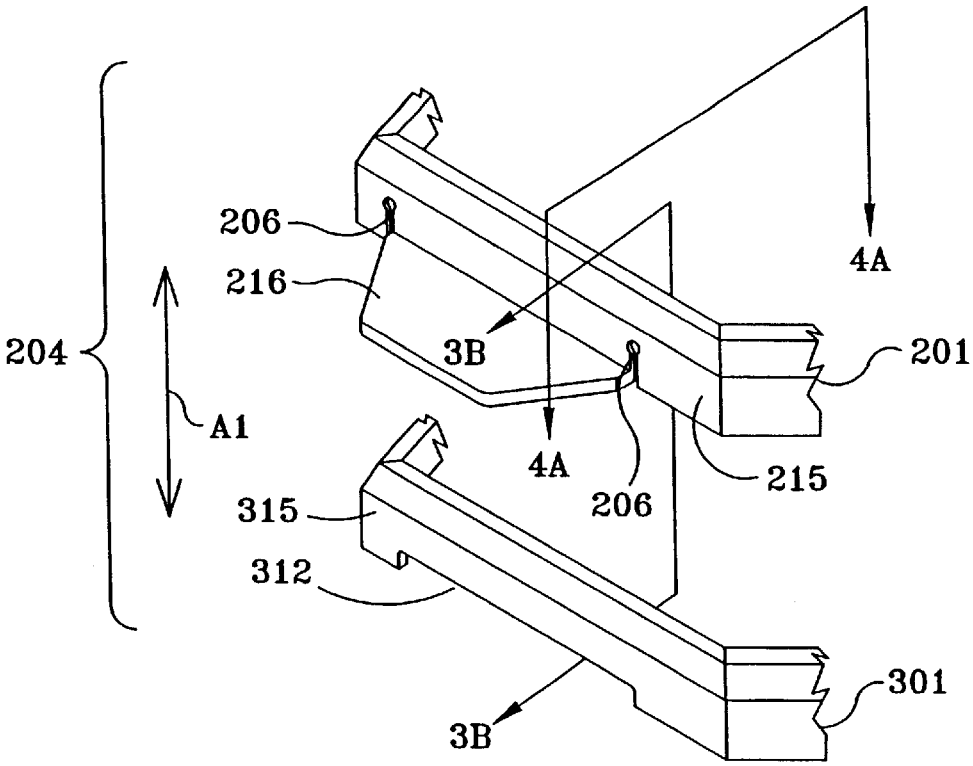
FIG. 3A is an enlarged exploded perspective view of area 3A in FIG. 1 showing the mating action of the first and second stiffener sections.
Figure 3B:
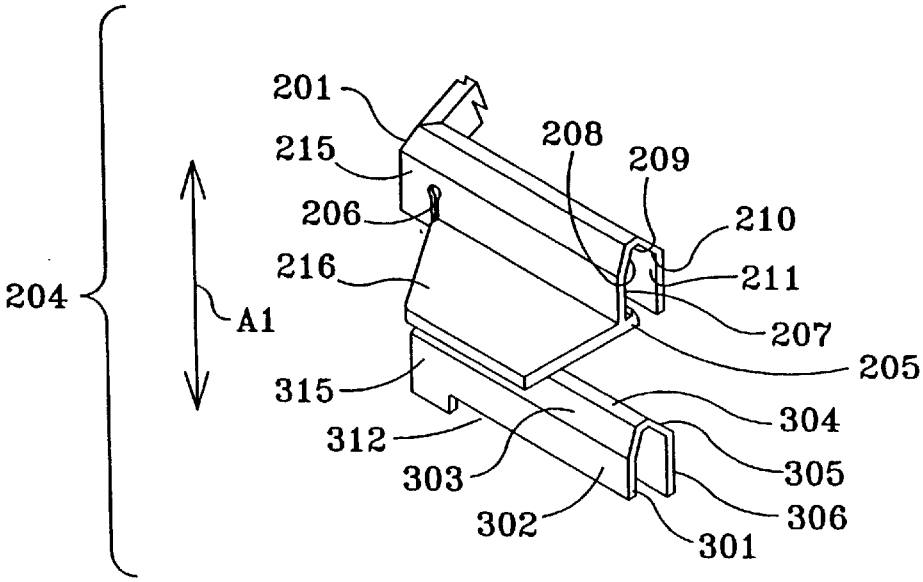
FIG. 3B is an exploded partial perspective cross sectional view taken along line 3B—3B in FIG. 3A showing the mating of the first and second stiffener sections.
Figure 4A:
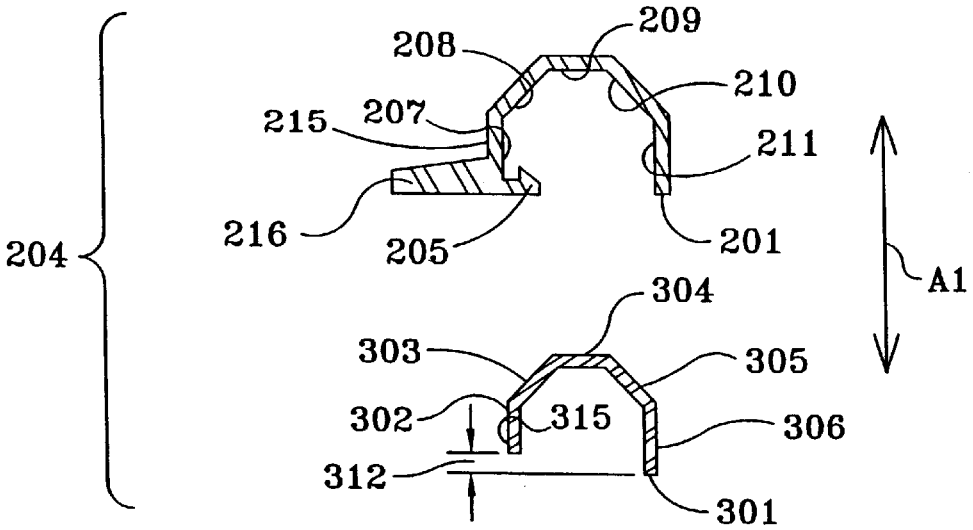
FIG. 4A is a cross sectional view taken along line 4A—4A in FIG. 3A showing the mating action of the first and second stiffener sections.
Figure 4B:
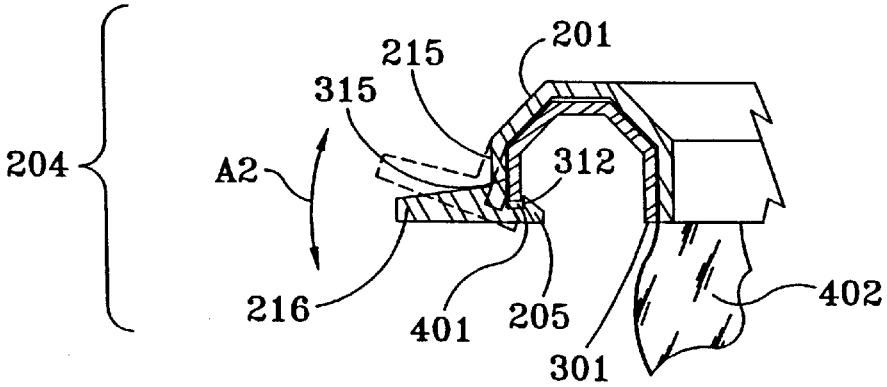
FIG. 4B is a cross sectional view taken along line 4B—4B in FIG. 7A of the first and second stiffener sections shown in a clamped position and showing the clamp locking action in broken lines.
Figure 4C:
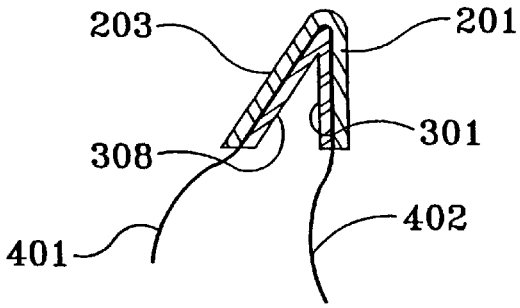
FIG. 4C is a cross sectional view taken along line 4C—4C in FIG. 7A showing the scooping ramp edge provided on the stiffener apparatus for channeling trash into a trash container opening.
Figure 7A:
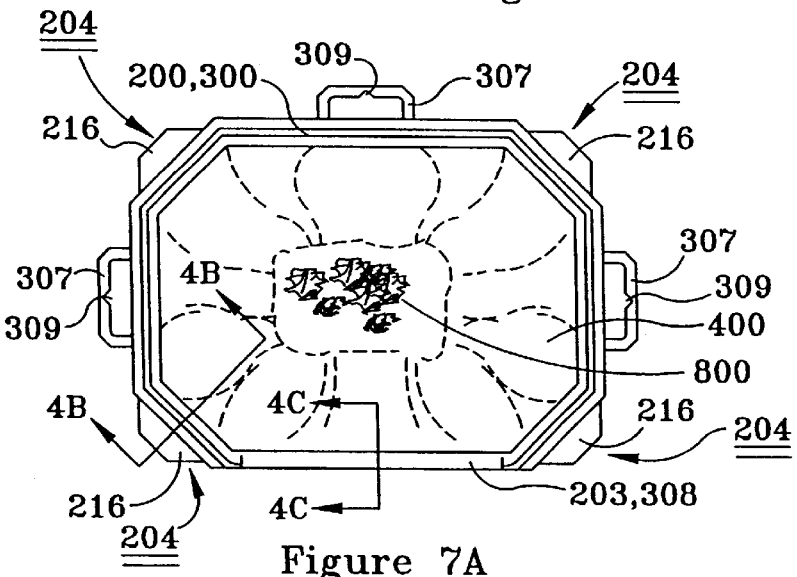
FIG. 7A is a top plan view of the stiffener apparatus with a flexible trash container installed in accordance with the present invention.
Figure 7C:
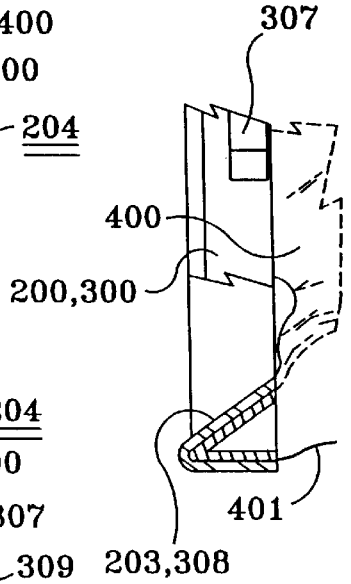
FIG. 7C is a partial cut-away side view of the stiffener apparatus with a flexible trash container installed in accordance with the present invention, showing an enlargement of the scooping ramp edge in a position for use in channeling trash into a flexible trash container opening.

Referring now to FIGS. 3A, 3B, 4A, 4B, and 4C, by design, structures 201, 301 are dimensionally sized for nested engagement as indicated by arrow A1. The female stiffener structural section 201 engages male stiffener structural section 301 such that the plurality of inner wall surfaces 207, 208, 209, 210 and 211 engage with outer wall surfaces 302, 303, 304, 305 and 306. FIG. 4B a cross-sectional view taken along the line 4B—4B in FIG. 7A shows the female stiffener structural section 201 and the male stiffener structural section 301 in the engaged position, securing an upper portion 401 of the opening of trash bag 400 and permitting a lower portion 402 of the opening of trash bag 400 to hang freely. FIG. 4C a cross-sectional view taken along the line 4C—4C in FIG. 7A shows an inner wall of scooping ramp edge member 203 engaged with an outer wall of scooping ramp edge member 308. FIG. 7C shows a partial cutaway view of the engaged inner wall of scooping ramp edge member 203 and the outer wall of scooping ramp edge member 308.

Referring now to FIGS. 3A, 3B,4A, and 4B, to assure that the stiffener sections 200, 300 remain engaged and firmly securing the opening of the trash bag 400, stiffener apparatus 100 is provided with a plurality of clamp assemblies 204 evenly distributed about stiffener apparatus 100. FIGS. 3A, 3B, 4A, and 4B show the clamp assembly and the action required for mating structures 201, 301 and for securing the mating by engaging the components of the clamp assembly 204. FIG. 3A shows a perspective partial view of clamp assembly region 3A in FIG. 1. FIG. 3B shows a perspective cross sectional view taken along the line 3B—3B in FIG. 3A showing interior detail of the clamp assembly 204. FIG. 4A, shows a cross sectional view taken along the line 4A—4A in FIG. 3A showing the clamp assembly 204 of structures 201, 301. FIG. 4B shows a cross-sectional view taken along line 4B—4B in FIG. 7A showing the engagement action of the clamp assembly 204 as indicated by arrow A2.

As shown in FIGS. 3B and 4A the clamp assembly 204 comprises a latching tab 205 located on structure 201 and a latching notch 312 located on structure 301. The latching tab 205 is formed as a portion of and at the lower edge of outer wall 215 of section 201, and the latching tab 205 is formed essentially perpendicular and extending inward to the outer wall 215 to engage the latching notch 312. The latching notch 312 is formed as an elongated notch on the lower edge of the outer wall 315 of structure 301 wherein the notch 312 is positioned to engage with the latching tab 205.

To facilitate engagement and disengagement of the clamping apparatus 204, a plurality of levers 216 are formed at the lower edge of the outer wall 215, the levers 216 are connected to and extend outward from the latching tab 205, and are connected to the outer wall 215 in a position essentially opposite the latching tabs 205. Engagement and disengagement is accomplished by rotation of lever 216. The line of rotation is shown by arrow A2. Also to facilitate engagement and disengagement of the clamping apparatus 204, a plurality of slots 206 are formed on the outer wall 215, the slots 206 extend upward in the outer wall 215, and the slots 206 are formed adjacent to each end of the levers 216. The slots provide sufficient flexibility in the outer wall 215 to facilitate engagement and disengagement of the clamp assembly 204. Upon engagement of sections 200, 300 the latching tab 205 engages the latching notch 312 clamping sections 200, 300 securely together. Disengagement of sections 200, 300 is accomplished by rotating the lever 216 while pulling sections 200, 300 apart, thus disengaging the latching notch 312 from the latching tab enabling sections 200, 300 to be separated.

Handles 307 are disposed on stiffener section 300 such that, after engagement, the handles 307 protrude from beneath the structural section 301 through grooves 310 formed in the structural section 301 as shown in FIG. 1. Handles 307 are formed to contain a plurality of notches 309 positioned such that when the stiffener apparatus 100 is placed to engage the notch 309 with a device designed for receiving articles, for example a nail partially driven into a wall or fence post, the stiffener apparatus 100 will hang in a stable and essentially level position, thus facilitating filling the opened bag 400, as shown in FIGS. 9A and 9B. Thus, FIG. 2 shows sections 200,300 in an engaged state where an upper peripheral portion 401 of the opening of trash bag 400 is captured between the structural sections 201, 301, including being captured between scooping ramp edge members 203, 308. Clamp assemblies 204 are distributed about structural section 201 for latching to structural section 301 and assuring a secured engagement of the stiffener sections with the interdisposed portion 401 of trash bag 400. The geometric design of structural sections 201, 301 is preferably a closed-end octagonal loop having a-multisurfaced, U-shaped channeled body. The octagonal shape provides a plurality of tension points about the circumference of sections 201, 301, and thus create a firm compression state of the captured material 401. Additionally, the multi-surface contact of walls (207, 208, 209, 210, 211), (302, 303, 304, 305, 306) with the interdisposed material 401 also provide tension points that complement the tension points created by the octagonal configuration of sections 201, 301. The firmly held trash bag facilitates carrying heavy trash loads 800 without slipping from the stiffener apparatus. The apparatus 100 accommodates large sized trash bags 400, typically with a capacity of 33 to 50 gallons, and having elongated sides 402. As shown in FIG. 6, an alternative embodiment of apparatus 100 is dimensionally sized to accommodate smaller bags 410, typically with a capacity of 1 to 2 gallons, exemplified by retail store plastic bags such as grocery bags.

Figure 5A:
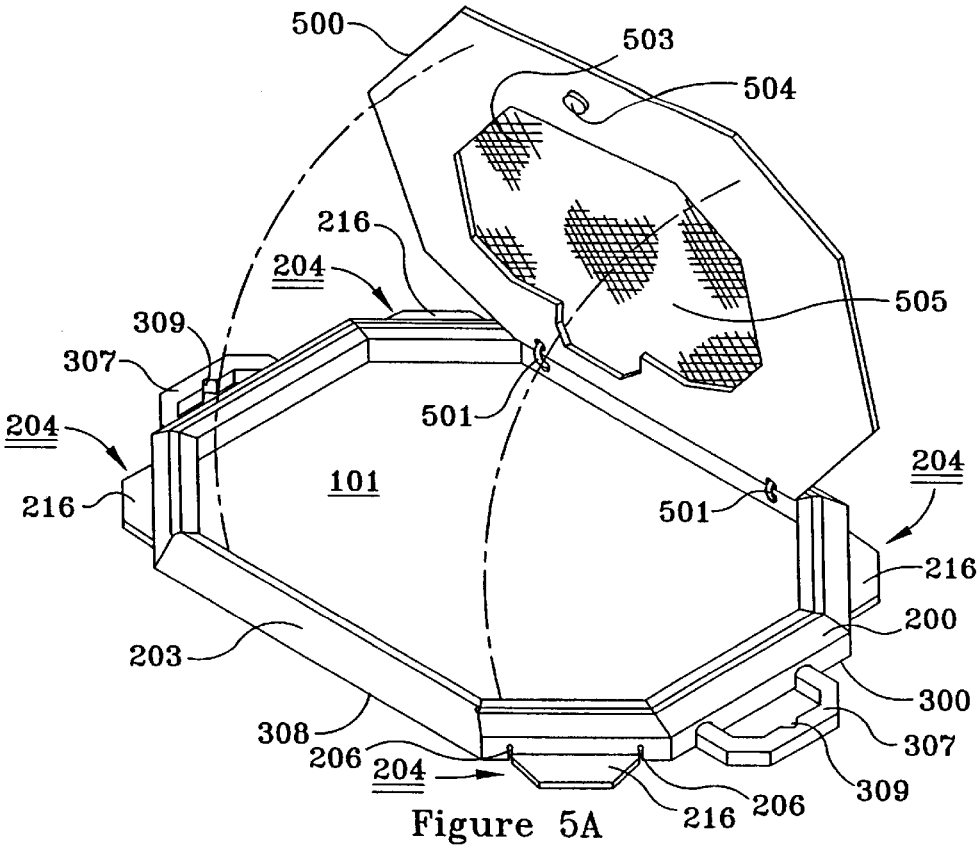
FIG. 5A is a perspective view of the stiffener apparatus shown in FIG. 2 with an optional cover in the open position.
Figure 5B:
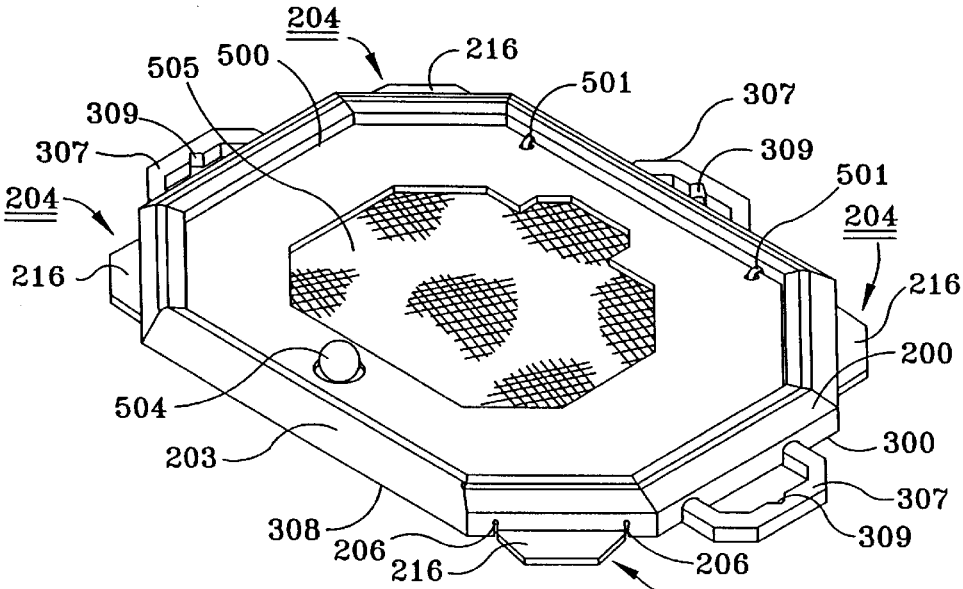
FIG. 5B is a perspective view of the stiffener apparatus shown in FIG. 2 with an optional cover in the closed position.

Referring now to FIGS. 5A and 5B, optionally, the stiffener apparatus 100 may also include an attached hinged cover 500 as shown. The cover 500 is made of rigid material, for example plastic or metal. The cover 500 is formed in a solid sheet or, alternatively, is formed to define a cover opening 505 in the cover 500. The opening 505 is covered with flexible mesh material 503 to facilitate air circulation yet prevent insects and vermin from entering. The cover is shaped to fit the stiffener opening 101 defined by the structure 201, dimensionally sized to cover the stiffener opening 101 and the cover 500 does not fall through the stiffener opening 101. The cover is connected to section 200 by hinges 501 and includes a lifting handle 504 for grasping and lifting the cover 500. The lifting handle 504 is connected to the cover 500 and is located distally to the hinges 501 to facilitate opening the cover 500.

Figure 7B:
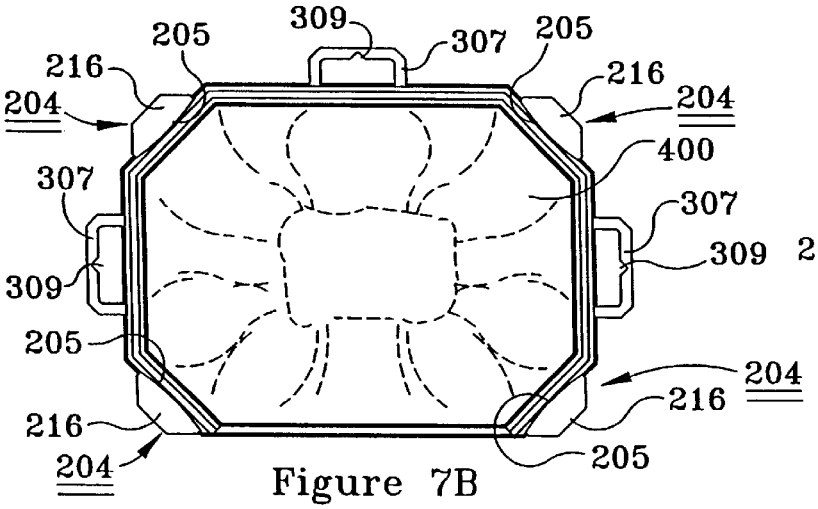
FIG. 7B is a bottom plan view to the stiffener apparatus with a flexible trash container installed in accordance with the present invention.

FIG. 7A shows a top plan view of the stiffener sections 200, 300 installed on flexible trash container 400 loaded with trash 800. FIG. 7B shows, in particular, clamp assemblies 204 attached and clamping section 201 to section 301. Handles 307 are provided on three different sides of apparatus 100 to enhance portability, and orientation for hanging from a wall. Also, and as best seen in FIG. 7C, apparatus 100 is shown with mated scooping ramp edges 203, 308, which enhance the utility of the stiffener 100 by providing means for channeling trash into a flexible trash container opening.

As discussed previously, the multi-surfaced substantially u-shaped channel construction of sections 201, 301 greatly enhances the gripping capability of the stiffener apparatus. By example, FIG. 4B shows trash bag portion 401 with side 402 in a cross-section view taken along line 4B—4B in FIG. 7A. Here the upper edge 401 of the bag opening is tightly compressed between the walls of first and second stiffener sections 201, 301. The body of sections 201, 301 preferably comprises mating multiple planar surfaces (207, 208, 209, 210, 211), (302, 303,304,305,306) that engage to firmly clamp the sheet material there between. Similarly, corresponding sides of sections 201, 301 comprise scooping ramp edge members 203, 308 that are mechanically mated as indicated in FIG. 4C, and comprise a cross-section taken along line 4C—4C in FIG. 7A. Trash bag portion 401 is also captured between the walls of scooping ramp edges 203, 308.

FIG. 8 shows a preferred application of the present invention. In this application sections 200, 300 are mechanically mated and are used to hold the opening of a trash bag 400 in an opened state. In use, the installed stiffener 100 is positioned in a vertical position, exposing the bag's opening such that the scooping ramp edges 203, 308 are flush with a ground plane to facilitate channeling trash 800, using a broom B, or similar pushing device, into the flexible trash container 400.

FIG. 6 shows an alternative one-handle embodiment of the invention. In this embodiment, the stiffener structures 201, 301 are dimensionally sized to form a stiffener apparatus 100 for use with small plastic bags 410, for example retail store bags exemplified by grocery bags.

FIGS. 9A and 9B show another preferred application of the invention. In this application sections 200, 300 are mechanically mated and are used to hold the opening of a flexible mesh bag 420 in an opened state. In use, the installed stiffener 100 is hung in an essentially vertical position from a hanger 421, exposing the mesh bag's 420 opening such that the flexible mesh material bag 420 facilitates receiving and storing of objects S such as sporting equipment, balls, toys, or clothing.

FIG. 10 shows yet another preferred application of the invention. In this application the stiffener apparatus 100 with a flexible mesh material 600 installed in accordance with the present invention are used in a sifting/sieving task.

Therefore, while the present invention has been shown and described herein in what is believed to be the most practical and preferred embodiment, it is recognized that departures can be made therefrom within the scope of the invention, which is therefore not to be limited to the details disclosed herein but is to be accorded the full scope of the claims so as to embrace any and all equivalent apparatus.

INDUSTRIAL APPLICABILTY

The present invention finds industrial applicability in the field of stiffener devices for stiffening openings of flexible containers. More particularly, the present invention relates to stiffeners for stiffening openings of flexible trash bag containers and for stiffening other flexible sheet material that is functional in a stiffened state. The invention provides a solution to the problem of maintaining plastic trash bags and other bags in an open state while a user fills the bag with trash, leaves or other materials. The stiffener additionally has commercial applicability for keeping storage bags open and for providing a secure frame for supporting flexible mesh materials for use in sieving/sifting operations.

SCOPE OF THE INVENTION

Information as herein shown and described in detail is fully capable of attaining the foregoing objects of the invention, the presently preferred embodiment of the invention, and is, thus, representative of the subject matter broadly contemplated by the present invention. The scope of the present invention fully encompasses other embodiments which may become obvious to those skilled in the art, and is to be limited, accordingly, by nothing other than the appended claims, wherein reference to an element in the singular is not intended to mean "one and only one" unless explicitly so stated, but rather "one or more". Further, wherein reference is made to "two" elements, this is not intended to mean "two and only two" unless explicitly so stated, but rather "two or more". All structural and functional equivalents to the elements of the foregoing preferred embodiment and additional embodiments, that are known to those of ordinary skill in the art are hereby expressly incorporated by reference, are intended to be encompassed by the present claims.

Moreover, no requirement exists for a device or method to address each and every problem sought to be resolved by the present invention, for such to be encompassed by the present claims. Furthermore, no element, component, or method step in the present disclosure is intended to be dedicated to the public regardless of whether the element, component, or method step is explicitly recited in the claims. However, various changes and modifications in form should be readily apparent to those skilled in the art, fabrication material detail may be made without departing from the spirit and scope of the invention as set forth in the appended claims. No claim herein is to be construed under the provisions of 35 U.S.C. '112, sixth paragraph, unless the element is expressly recited using the phrase "means for".

I claim:

1. A stiffener apparatus comprising:

clamping means having a first and a second stiffener section for securing a flexible sheet material when said flexible sheet material is disposed therebetween, said first stiffener section having latching means, said latching means being removably attachable to said second stiffener section, said latching means further including lever means for engaging and disengaging said latching means; and at least one handle provided on said second stiffener section for manipulating said stiffener apparatus, said at least one handle having at least one notch for hanging said stiffener apparatus, said notch disposed so that said stiffener apparatus hangs essentially level and vertical, said first stiffener section also including a plurality of slots, said slots being located adjacent opposite ends of said lever means to provide flexibility to said latching means for engaging and disengaging said latching means.

2. A stiffener apparatus as described in claim 1, wherein:

said stiffening apparatus is geometrically shaped, having a substantially U-shaped cross section, and having a side member formed as a scooping ramp edge.

3. A stiffener apparatus as described in claim 1, further comprising:

covering means attached to said first stiffener section.

4. A stiffener apparatus as described in claim 3, wherein:

said stiffening apparatus is geometrically shaped, having a substantially U-shaped cross section, and having a side member formed as a scooping ramp edge.

5. A stiffener apparatus comprising:

clamping means for securing a flexible sheet material when said flexible sheet material is disposed between a first and a second stiffener section, said first stiffener section having latching means, said latching means being removably attachable to said second stiffener section, said latching means further including lever means for engaging and disengaging said latching means, said first stiffener section having a plurality of slots adjacent opposite ends of said lever means to provide flexibility to said latching means for engaging and disengaging of said latching means; and covering means attached to said first stiffener section.

6. A stiffener apparatus as described in claim 5 further comprising:

at least one handle provided on said second stiffener section for manipulating said stiffener apparatus, said at least one handle having at least one notch for hanging said stiffener apparatus, said notch disposed so that said stiffener apparatus hangs essentially level and vertical.

7. A stiffener apparatus as described in claim 6, wherein:

said stiffening apparatus is geometrically shaped, having a substantially U-shaped cross section, and having a side member formed as a scooping ramp edge.

8. A method for stiffening an opening of a flexible bag comprising:

a) separating a first stiffener section and a second stiffener section of a stiffener apparatus, said first stiffener section having latching means, said latching means further having lever means for engaging and disengaging said latching means, said first stiffener section having a plurality of slots adjacent opposite ends of said lever means, for facilitating engaging and disengaging said latching means whereby said separating is caused by lifting and rotating said lever from the slots and disengaging said lever from said latching means;

b) placing said opening of said bag between said first and said second stiffener sections;

c) clamping together said first and second stiffener sections, thereby stiffening said opening of said flexible bag; and d) removably latching said first stiffener section to said second stiffener section.

* * * * *